US010981291B2

(12) United States Patent
Haneda et al.

(10) Patent No.: US 10,981,291 B2
(45) **Date of Patent: *Apr. 20, 2021**

(54) ELECTRIC CHAINSAW

(71) Applicant: MAKITA CORPORATION, Anjo (JP)

(72) Inventors: Koji Haneda, Anjo (JP); Hideki Kachi, Anjo (JP); Yasuyuki Kawabata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/522,722

(22) Filed: Jul. 26, 2019

(65) Prior Publication Data

US 2019/0381687 A1 Dec. 19, 2019

Related U.S. Application Data

(62) Division of application No. 15/328,364, filed as application No. PCT/JP2015/069627 on Jul. 8, 2015, now Pat. No. 10,406,713.

(30) Foreign Application Priority Data

Jul. 22, 2014 (JP) ..... 2014-149058

(51) Int. Cl.
*B27B 17/08* (2006.01)
*B27B 17/02* (2006.01)
*B27B 17/00* (2006.01)

(52) U.S. Cl.
CPC ..... *B27B 17/08* (2013.01); *B27B 17/00* (2013.01); *B27B 17/0008* (2013.01); *B27B 17/02* (2013.01)

(58) Field of Classification Search
CPC ..... B27B 17/08; B27B 17/00; B27B 17/0008; B27B 17/02
See application file for complete search history.

(56) References Cited

U.S. PATENT DOCUMENTS 3,757,194 A * 9/1973 Weber ..... A01G 3/053 320/112
6,237,698 B1 * 5/2001 Carrier ..... B25F 5/02 173/171

(Continued)

FOREIGN PATENT DOCUMENTS

EP 2 286 970 A1 * 2/2011
JP 2010-201612 A 9/2010
JP 2011-161602 A 8/2011

OTHER PUBLICATIONS

Aug. 18, 2015 International Search Report issued in International Patent Application No. PCT/JP2015/069627.

(Continued)

*Primary Examiner* — Hwei-Siu C Payer
(74) *Attorney, Agent, or Firm* — Oliff PLC

(57) ABSTRACT

To provide an easy-to-use electric chainsaw that uses, in place of a large battery pack with a high voltage rating that would have been used in conventional electric chainsaws, a battery power source composed of a set of small commonly used battery packs of the same rating. An electric chainsaw having a built-in electric motor that is powered by a rechargeable battery, wherein a set of commonly used battery packs of the same rating is used as the rechargeable battery. The set of battery packs is mounted at the back of the main housing so that the center of gravity (G) of the chainsaw is positioned within a range (R) of 1.5 time the width (W) of the grip section of a rear handle between the left and right sides of a center line that is centered in the horizontal direction.

8 Claims, 10 Drawing Sheets

(56) References Cited

U.S. PATENT DOCUMENTS

| | | | | |
|---|---|---|---|---|
| 7,958,642 | B2 | 6/2011 | Rosskamp | |
| 9,713,880 | B2 | 7/2017 | Haneda et al. | |
| 9,756,783 | B2 | 9/2017 | Nojiri et al. | |
| 9,827,622 | B2 | 11/2017 | Kani et al. | |
| 10,406,713 | B2 * | 9/2019 | Haneda | B27B 17/02 |
| 2008/0184568 | A1 * | 8/2008 | Gieske | B27B 17/0008 30/383 |
| 2010/0218386 | A1 * | 9/2010 | Ro kamp | A01G 3/053 30/277.4 |
| 2010/0218967 | A1 | 9/2010 | Ro kamp et al. | |
| 2011/0162219 | A1 | 7/2011 | Okouchi | |
| 2011/0197389 | A1 | 8/2011 | Ota et al. | |
| 2012/0321912 | A1 * | 12/2012 | Hachisuka | H01M 2/1022 429/7 |
| 2014/0054054 | A1 | 2/2014 | Osborne et al. | |
| 2014/0096986 | A1 * | 4/2014 | Hirabayashi | B23Q 15/12 173/2 |
| 2015/0165640 | A1 | 6/2015 | Ro kamp et al. | |
| 2017/0203462 | A1 | 7/2017 | Haneda et al. | |
| 2017/0259359 | A1 | 9/2017 | Kachi et al. | |
| 2019/0381687 | A1 * | 12/2019 | Haneda | B27B 17/00 |

OTHER PUBLICATIONS

Jan. 24, 2017 International Preliminary Report on Patentability issued in International Patent Application No. PCT/JP2015/069627.
Sep. 28, 2018 U.S. Office Action Issued in U.S. Appl. No. 15/328,364.

* cited by examiner

ELECTRIC CHAINSAW

This is a Continuation Application of U.S. patent application Ser. No. 15/328,364 filed Jan. 23, 2017, now U.S. Pat. No. 10,406,713, which claims the benefit of PCT Application No. PCT/JP2015/069627, filed Jul. 8, 2015, which claims the benefit of Japanese Patent Application No. JP 2014-149058, filed Jul. 22, 2014. The disclosure of the prior applications is hereby incorporated by reference herein in its entirety.

TECHNICAL FIELD

The present invention relates to an electric chainsaw that uses a rechargeable battery pack.

BACKGROUND ART

Patent Literature 1 discloses an electric chainsaw. The electric chainsaw includes a main housing incorporating an electric motor to which power is supplied by a rechargeable battery, a guide bar projecting toward a front side with a basal end fixed to a side part of the main housing, a saw chain (saw teeth chain) stretched over an outer periphery of the guide bar and driven by the electric motor, a rear handle extending toward a back side from a back part of the main housing, and an arch-shaped front handle having left and right lower ends fixed to both sides of the main housing, where a trigger switch for starting up the electric motor is arranged on the rear handle. When using the chainsaw, an operator grips the rear handle with the right hand (or left hand), grips a side handle with the left hand (or right hand), and operates the trigger switch with a finger of the right hand (or left hand) to activate the electric motor. The saw chain thereby rotates around the outer periphery of the guide bar, enabling the operator to execute a wood cutting task.

CITATION LIST

Patent Literature 1: Japanese Unexamined Patent Publication No. 2010-201612

SUMMARY OF INVENTION

Technical Problems

In the electric chainsaw described above, a large battery pack of high voltage standard (e.g., 36V) is incorporated to drive a high output electric motor. The application of the large battery pack of high voltage standard is limited to mainly the electric chainsaw and such battery pack is expensive, and furthermore, its general versatility is poor and in an actual situation, the financial strain on a user is large. In a technical field of electric tools, gardening tools, electric vacuum cleaners, and the like, a small commonly used battery pack of the same standard is being developed.

Focusing on the actual situation described above, the present invention provides an electric chainsaw that uses a battery power source configured by a set of commonly used small battery packs of the same standard in place of a large battery pack of high voltage standard that has been used in the conventional electric chainsaw. In such electric chainsaw, the problem to be solved lies in incorporating a set of commonly used small batteries at an appropriate position in a main housing without affecting the operability of the saw chain.

Solutions to Problems

In order to overcome the problem described above, the present invention provides an electric chainsaw including a main housing incorporating an electric motor to which power is supplied by a rechargeable battery; a guide bar projecting toward a front side with a basal end fixed to a side part of the main housing, a saw chain stretched over an outer periphery of the guide bar and driven by the electric motor, a rear handle gripped by an operator, the rear handle extending toward a back side from a back part of the main housing, and an arch-shaped front handle having left and right lower ends fixed to both sides of the main housing, the electric motor being started up by an operation of a trigger switch arranged on the rear handle; wherein a set of commonly used battery packs of a same standard is adopted for the rechargeable battery, the set of commonly used battery packs being assembled to the back part of the main housing so that a center of gravity G of the chainsaw is located within a range R of 1.5 times a width W (30 mm) on both left and right sides of a center line C extending perpendicularly at a center in a left and right direction of a grip section of the rear handle.

In the electric chainsaw of the present invention configured as above, the set of battery packs are arranged at the back part of the main housing so that the center of gravity G of the chainsaw is located deviated in the left and right direction in the range R of 1.5 times the width W (30 mm) on both left and right sides of the center line C extending perpendicularly at the center in the left and right direction of a grip section of the rear handle, whereby the main housing is slightly tilted in the left and right direction thus enhancing the operability of the saw chain. If the center of gravity of the set of battery packs is evenly deviated toward the left and right sides of the center line C extending perpendicularly at the center in the left and right direction of the grip section of the rear handle, a satisfactory left and right weight balance of the main housing can be realized.

In the electric chainsaw of the present invention, the attachment/detachment task of each battery pack can be facilitated by arranging and assembling the set of battery packs in parallel in the main housing.

In the electric chainsaw of the present invention, the electric motor can be used with high output when the set of battery packs are series-connected, whereas the electric motor can be used for a long period of time when the set of battery packs are parallel-connected.

BRIEF DESCRIPTION OF DRAWINGS

FIG. 14(*b*) is another right side view of the seventh alternative embodiment illustrating the back part of the main housing in an open position.

FIG. 15(*b*) is another right side view of the eighth alternative embodiment illustrating the back part of the main housing in an open position.

DESCRIPTION OF EMBODIMENTS

Figure 1:
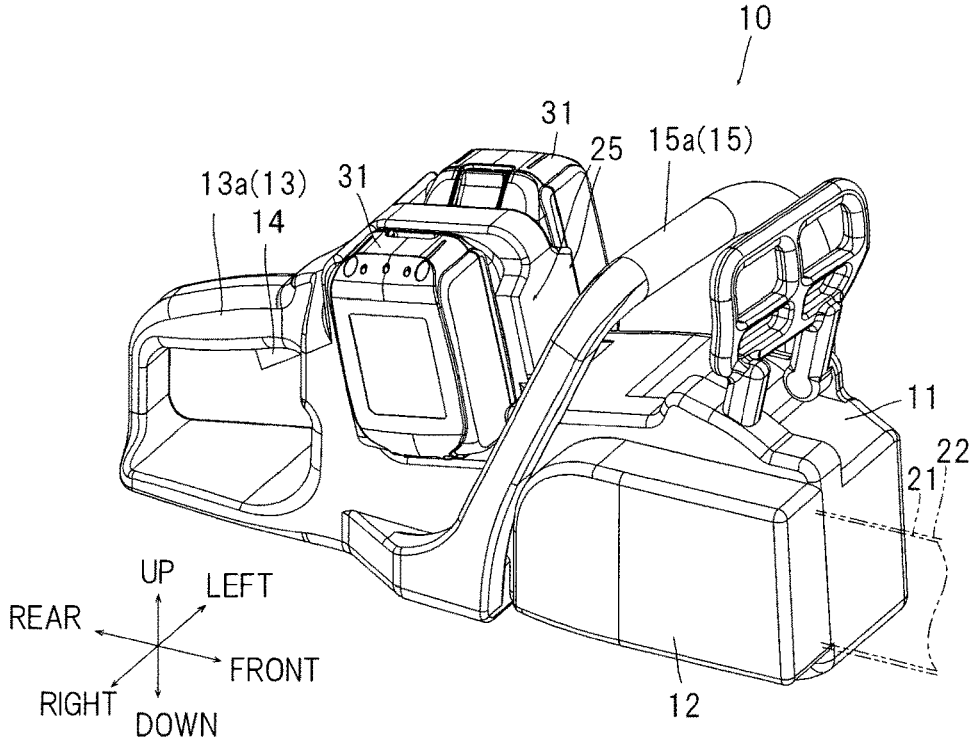
FIG. 1 is a perspective view showing one embodiment of an electric chainsaw of the present invention.
Figure 2:
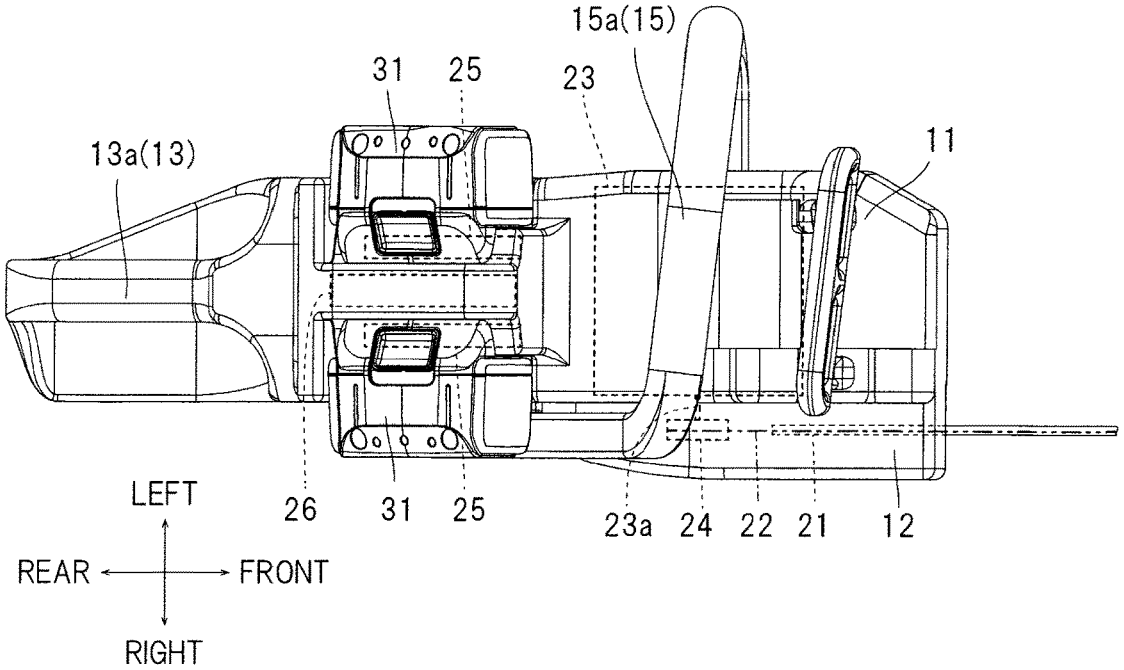
FIG. 2 is a plan view of the chainsaw shown in FIG. 1.
Figure 3:
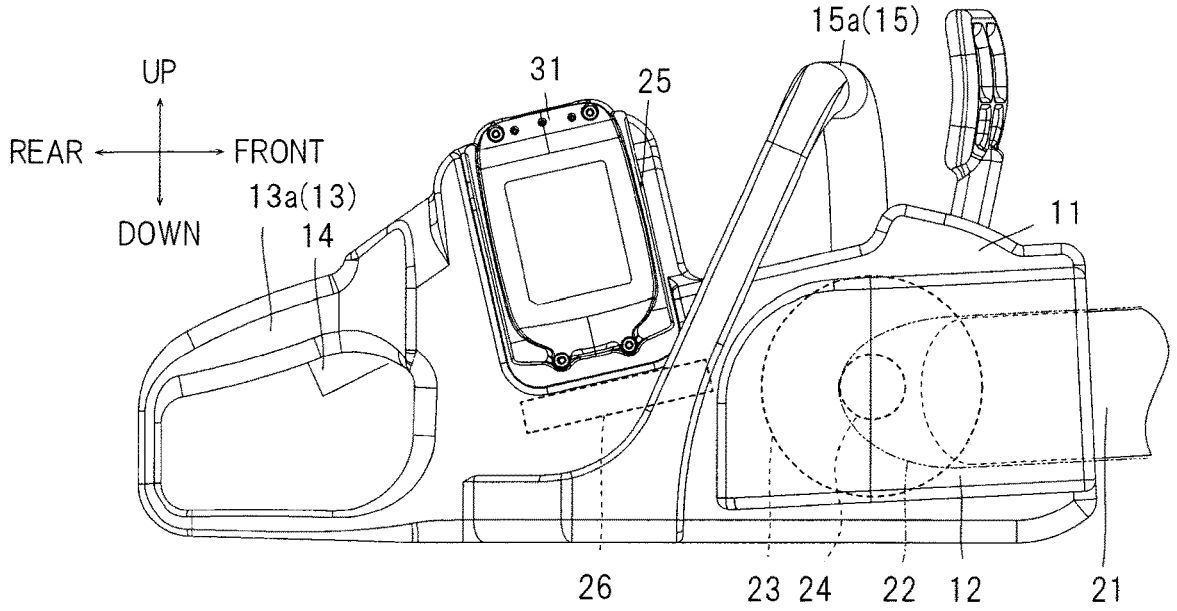
FIG. 3 is a right side view of the chainsaw shown in FIG. 1.

One embodiment of an electric chainsaw according to the present invention will be hereinafter described with reference to the drawings. As shown in FIGS. 1 to 3, an electric chainsaw 10 includes a main housing 11, where a longitudinal guide bar 21 is arranged to project out toward a front side at a front part of a right side surface of the main housing 11. A back part of the guide bar 21 is covered by a sprocket cover 12 arranged at the front part of the right side surface of the main housing 11, and a portion of the guide bar 21 excluding the back part is projected out toward a front side of the main housing 11. A loop-like saw chain 22 is rotatably attached to an outer periphery of the guide bar 21. The saw chain 22 is rotatably stretched between the guide bar 21 and a sprocket 24 rotatably supported on an immediate back side of the guide bar 21. A plurality of saw-like blades are continuously provided on the saw chain 22, so that the saw-like blades continuously travel at the outer periphery of the guide bar 21 when the saw chain 22 is rotated at the outer periphery of the guide bar 21.

As shown in FIGS. 2 and 3, an electric motor 23 is accommodated at a front part of the main housing 11, and the electric motor 23 causes the saw chain 22 to rotate along the outer periphery of the guide bar 21. An output shaft 23*a* of the electric motor 23 is projected into the sprocket cover 12, and the sprocket 24 is fixed to the output shaft 23*a*. When the sprocket 24 is rotated by the drive of the electric motor 23, the saw chain 22 rotates along the outer periphery of the guide bar 21 by the rotating sprocket 24.

As shown in FIGS. 1 to 4, a rear handle 13 extending toward a back side is arranged at the back part of the main housing 11, and a front handle 15 is arranged at an intermediate part in a front and back direction of the main housing 11. When seen from a side surface, the rear handle 13 has a substantially U shape laid in a direction in which the back side is closed, and an upper part of the rear handle 13 serves as a grip section 13*a* to be gripped by an operator. The grip section 13*a* of the rear handle 13 has a substantially circular cross-sectional shape in a direction orthogonal to a longitudinal direction, where a horizontal width W of the grip section 13*a* is set to 30 mm, a width suited to a size for being gripped with a hand. A range suited for gripping a horizontal length of the grip section 13*a* with the hand is 25 mm to 40 mm. A trigger switch 14 is arranged on a lower surface side at the front part of the grip section 13*a* of the rear handle 13, and the electric motor 23 is driven by push operating the trigger switch 14.

As shown in FIGS. 1 to 4, the front handle 15 has a substantially U shape in which a lower side is opened to cross the intermediate part in the front and back direction of the main housing 11, where both ends in the longitudinal direction of the front handle 15 are fixed to both side parts of the main housing 11. In the front handle 15, the intermediate part, which becomes the upper side of the main housing 11, is assumed as a grip section 15*a* to be gripped by the operator. The front handle 15 has a substantially U shape in which the lower side is opened, but this is not the sole case, and may be an O shape forming a loop form.

Figure 4:
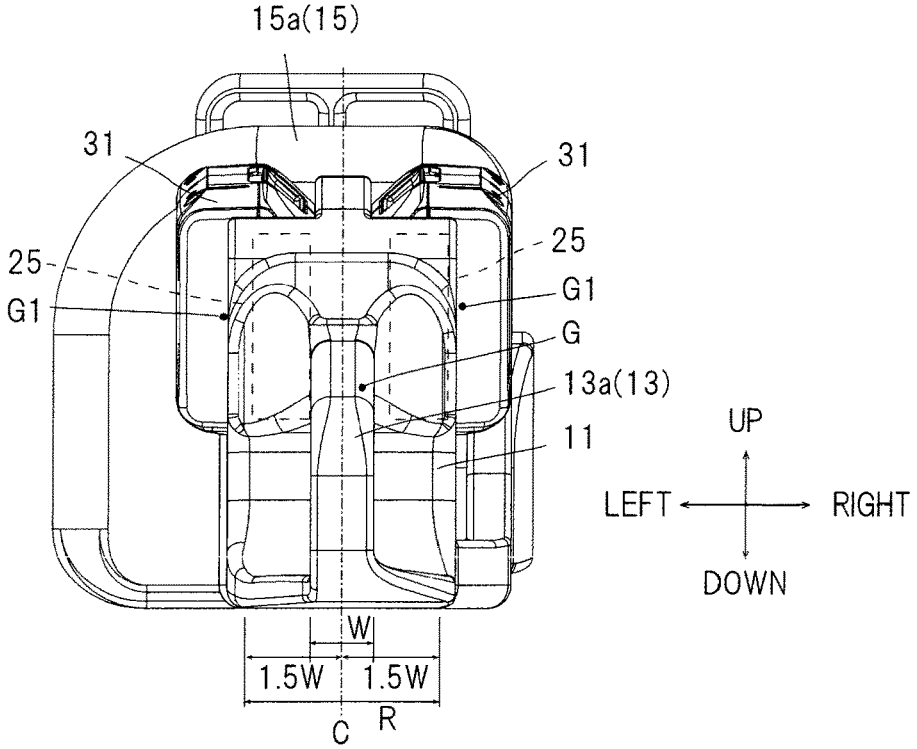
FIG. 4 is a rear view of the chainsaw shown in FIG. 1, and is a view showing a center of gravity of the chainsaw when seen from a back side.
Figure 5:
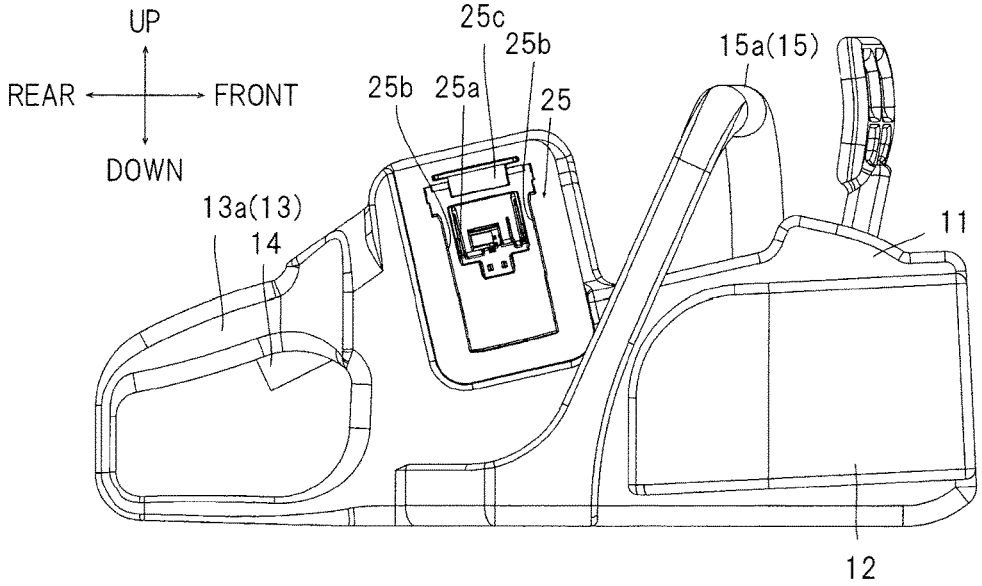
FIG. 5 is a right side view of a state in which a battery pack is detached.

As shown in FIGS. 1 to 4, a battery power source 30 that supplies power to the electric motor 23 is removably attached to the back part of the main housing 11, and the battery power source 30 of the embodiment includes a pair of battery packs 31 arranged side by side on both left and right sides at the back part of the main housing 11. FIG. 5 is a right side view of the main housing 11 with the battery pack 31 detached, where two attachment sections 25 for attaching the pair of battery packs 31 are arranged at a central part of the back part of the main housing 11 (in FIG. 5, only the attachment section on the right side is shown, and the illustration of the attachment section on the left side, which is symmetric to the attachment section on the right side, is omitted). The two attachment sections 25 are arranged at positions adjacent to each other at the central part of the back part of the main housing 11. The attachment section 25 is arranged by the same number as the battery pack 31.

The attachment section 25 includes a connector portion 25*a* removably connected to an electric connector 34 of the battery pack 31. The connector portion 25*a* is electrically connected to the electric motor 23, where when the electric connector 34 of the battery pack 31 is electrically connected to the connector portion 25*a*, the electric motor 23 is electrically connected to the battery pack 31. A pair of left and right guide rails 25*b* extending in an up and down direction are arranged on both left and right sides of the connector portion 25*a*, and the battery pack 31 is attached to be slidably movable in the up and down direction along the guide rails 25*b*. A locking portion 25*c* formed to recess toward an inner side is formed at the upper part of the attachment section 25, so that a hook 36 provided on the battery pack 31 can be locked to the locking portion 25*c*. When the hook 36 of the battery pack 31 is locked to the locking portion 25*c* of the attachment section 25, the battery pack 31 is regulated from moving along the guide rails 25*b* on the attachment section 25.

The battery pack 31 is used as a battery power source of the electric motor 23, and can be charged using a charger (not shown). Furthermore, the battery pack 31 is a power source having high versatility that can be used as a power source for various types of electric tools and electric gardening tools. The battery pack 31 of the embodiment has a nominal voltage of 18V, and is widely used in various types of electric tools and gardening tools. In the embodiment, two battery packs 31 are series-connected with respect to the electric motor 23 to be used as a 36V power source.

Figure 6:
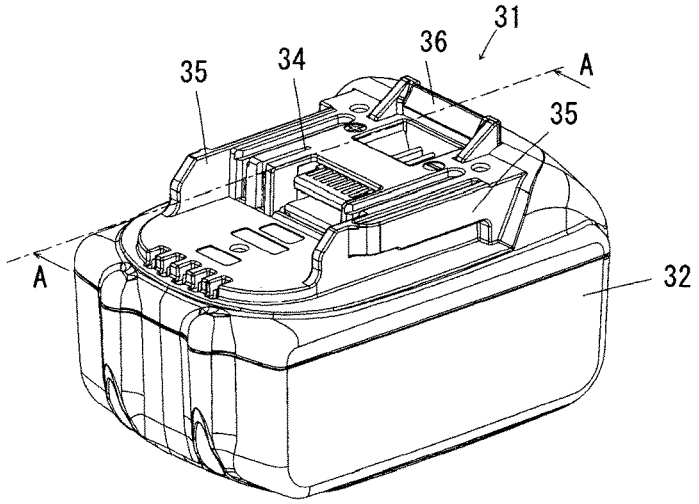
FIG. 6 is a perspective view showing the battery pack.
Figure 7:
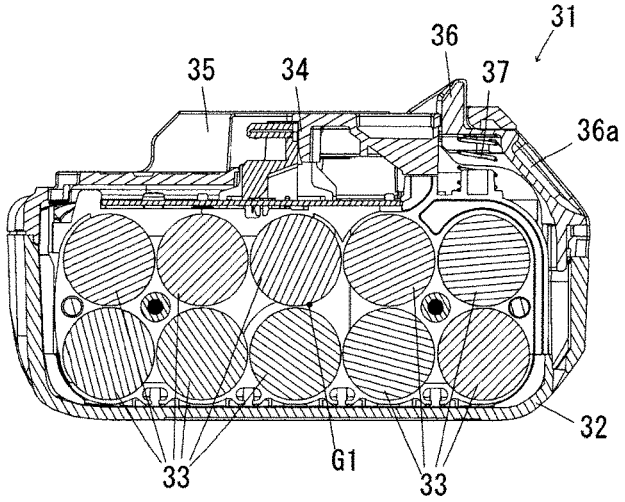
FIG. 7 is a cross-sectional view taken along line A-A of FIG. 6.

As shown in FIGS. 6 and 7, the battery pack 31 includes a substantially cuboid shaped housing 32, and ten battery cells 33 having a circular column shape are accommodated in the housing 32. In the battery pack 31, a longitudinal direction of the housing 32 is assumed as a direction of slidably moving to and attaching to the attachment section 25, and the battery cells 33 are accommodated with an axis line direction thereof lying in a direction orthogonal to the direction of slidably moving to and attaching to the attachment section 25. In the battery pack 31, a substantially center position of the housing 32 is a center of gravity G1.

An upper wall (peripheral wall) shown in FIG. 6 of the housing 32 is a wall surface facing the attachment section 25, and the electric connector 34 removably connected to the connector portion 25*a* of the attachment section 25 is arranged on the upper wall of the housing 32. As described above, the electric motor 23 and the battery pack 31 are electrically connected by electrically connecting the connector portion 25*a* of the attachment section 25 to the electric connector 34. A pair of rails 35 extending in the longitudinal direction are integrally formed at the upper wall, shown in FIG. 6, of the housing 32. The pair of rails 35 are arranged on both sides of the electric connector 34 in a direction orthogonal to the longitudinal direction of the housing 32. The hook 36 projecting out toward the upper side (toward the attachment section 25) is arranged on the upper wall, shown in FIG. 6, of the housing 32, and this hook 36 is biased toward the upper side (toward the locking portion 25*c* of the attachment section 25) shown in FIG. 6 by a spring member 37.

When the hook 36 is locked to the locking portion 25*c* of the attachment section 25 with the battery pack 31 attached to the attachment section 25, the electric connector 34 of the battery pack 31 is electrically connected to the connector portion 25*a* of the attachment section 25, and the battery pack 31 is regulated from moving along the guide rail 25*b*. When the hook 36 is retreated from the locking portion 25*c* against the biasing force of the spring member 37 with a release button 36*a*, the battery pack 31 becomes slidably movable along the guide rails 25*b*. If the battery pack 31 is slidably moved along the guide rails 25*b* in this state, the electric connection of the electric connector 34 of the battery pack 31 and the connector portion 25*a* of the attachment section 25 is released, and the battery pack 31 is detached from the attachment section 25.

As shown in FIGS. 2 and 3, a controller 26 that controls the power supply from the battery pack 31 to the electric motor 23 and the drive of the electric motor 23 is arranged inside the main housing 11, and the controller 26 is arranged on a lower side of the attachment section 25 at a position proximate to a position where the attachment section 25 is arranged.

In the chainsaw 10 configured as above, when the grip section 13*a* of the rear handle 13 is gripped with the right hand, the grip section 15*a* of the front handle 15 is gripped with the left hand, and the trigger switch 14 at the front part of the grip section 13*a* is push operated with a forefinger of the right hand, the electric motor 23 is driven by the power supply from the two battery packs 31. The saw chain 22 rotates along the outer periphery of the guide bar 21 when the sprocket 24 is rotated by the drive of the electric motor 23. When the saw chain 22 rotating along the outer periphery of the guide bar 21 makes contact with lumber such as a log in such a state, the lumber such as the log is cut by the saw chain 22 rotating along the outer periphery of the guide bar 21.

In the chainsaw 10 configured as above, the pair of rechargeable battery packs 31 that can be used in various types of electric tools and gardening tools are used for the battery power source 30 that supplies power to the electric motor 23. A user does not need to possess a battery pack of a variety of standards (e.g., different voltages) with the chainsaw 10, and the electric tool, the gardening tool since the battery pack 31 of high versatility that can be used even for electric tools and gardening tools is used for the battery power source of the chainsaw 10, thus enhancing the usability of the user.

A center of gravity G of the chainsaw 10 is mainly defined by a position of the electric motor 23, which is a heavy load, a position of the guide bar 21, and a position of the pair of battery packs 31, which are also heavy loads. The operability may lower if the position of the center of gravity G of the chainsaw 10 is inappropriate. As shown in FIG. 4, the pair of battery packs 31 are arranged at the back part of the main housing 11 such that the center of gravity G of when seen from the back side of the chainsaw 10 is located deviated in the left and right direction in a range R of 1.5 times a width W (30 mm) on both left and right sides of a center line C extending perpendicularly at a center in the left and right direction of the grip section 13*a*. Thus, the main housing of the chainsaw 10 is less likely to tilt in the left and right direction when the grip section 13*a* of the rear handle 13 of the chainsaw 10 is gripped, whereby the grip section 13*a* does not need to be strongly gripped and the operator is less likely to get tired. Furthermore, the center of gravity G of when seen from the back side of the chainsaw 10 is slightly deviated toward a right side from the center line C within the range R of 1.5 times a length width W (30 mm) on both left and right sides of the center line C extending perpendicularly at the center in the left and right direction of the grip section 13*a*. The main housing of the chainsaw 10 is thereby slightly tilted toward the right side (left and right direction), and the operability of the chainsaw 10 can be improved.

Each center of gravity G1 of the pair of battery packs 31 is located in the range R of 1.5 times the width W (30 mm) of the grip section 13*a* on both left and right sides of the center line C extending perpendicularly at the center in the left and right direction of the grip section 13*a*. Furthermore, the pair of battery packs 31 are arranged such that each center of gravity G1 is divided to both left and right sides from the center line C extending perpendicularly at the center in the left and right direction of the grip section 13*a*. The weight balance in the left and right direction of the chainsaw 10 thus improves when the operator grips the grip section 13*a* of the rear handle 13, and hence the operator does not need to strongly grip the grip section 13*a* and the operator is more unlikely to get tired.

In such electric chainsaw 10, the pair of battery packs 31 are arranged at positions juxtaposed on the left and right at the back part of the main housing 11. The attachment/detachment task of the battery pack 31 by the user is thus facilitated compared to when the pair of battery packs 31 are arranged at positions spaced apart from each other.

Furthermore, in such chainsaw 10, the main housing 11 includes two attachment sections 25 corresponding to the two battery packs 31 at the back part thereof to attach the pair of battery packs 31. The battery pack 31 includes the electric connector 34 and the pair of rails 35 arranged on both sides of the electric connector 34 at the peripheral wall of the housing 32 incorporating the plurality of battery cells 33, and the attachment section 25 includes the connector portion 25*a* electrically connected to the electric connector 34 of the battery pack 31 and the pair of guide rails 25*b* that engage the pair of rails 35 in a freely slidably moving manner. The battery pack 31 can be attached while being electrically connected with respect to the attachment section 25 by slidably moving the pair of rails 35 of the battery pack 31 along the guide rails 25*b* of the attachment section 25, that is, by slidably moving the battery pack 31 with respect to the attachment section 25, whereby the operability of the attachment task of the battery pack 31 with respect to the attachment section 25 is enhanced.

Moreover, the battery pack 31 includes the hook 36 that projects out so as to be able to advance/retreat with respect to the attachment section 25, and the attachment section 25 includes the locking portion 25*c* that locks with the hook 36, where the hook 36 is biased by the spring member 37 to lock with the locking portion 25*c*. Since the hook 36 is biased by the spring member 37 to lock with the locking portion 25*c*, the battery pack 31 is regulated from slidably moving from the attachment section 25, so that the battery pack 31 is prevented from separating from the attachment section 25. The battery pack 31 can be slidably moved from the attachment section 25, and the battery pack 31 can be detached from the attachment section 25 by releasing the hook 36 from the locking portion 25*c* against the biasing force of the spring member 37. Thus, the battery pack 31 can be regulated from slidably moving or can be slidably moved with respect to the attachment section 25 by simply operating the hook 36, whereby the operability of the attachment task of the battery pack 31 with respect to the attachment section 25 is enhanced.

The guide rail 25*b* of the attachment section 25 is inclined approximately 10° toward the back side from a vertical direction, and the battery pack 31 is attached to the attachment sections 25 on both left and right sides while being inclined approximately 10° toward the back side at the back part of the main housing 11. As the battery pack 31 is attached while being inclined toward the back side, the operator can easily detach the battery pack 31 from the attachment section 25 by gripping the side handle 15 of the chainsaw 10 placed on the ground and the like with one hand and holding it down toward the ground side, and grabbing the battery pack 31 with the other hand and pulling out the battery pack 31 toward the diagonally upper back side, which is the side opposite to the side handle 15.

Next, other alternative embodiments using a pair of battery packs 31 in the electric chainsaw 10 will be described. In the following description, aspects different from the chainsaw 10 of the embodiment described above will be mainly described, and description on operation effects described above will be omitted unless otherwise stated. In regards to each figure of the alternative embodiment, the guide bar 21, the saw chain 22, and the electric motor 23 are similar to those described in the above embodiment, and hence will not be illustrated and will be omitted.

First Alternative Embodiment

Figure 8:
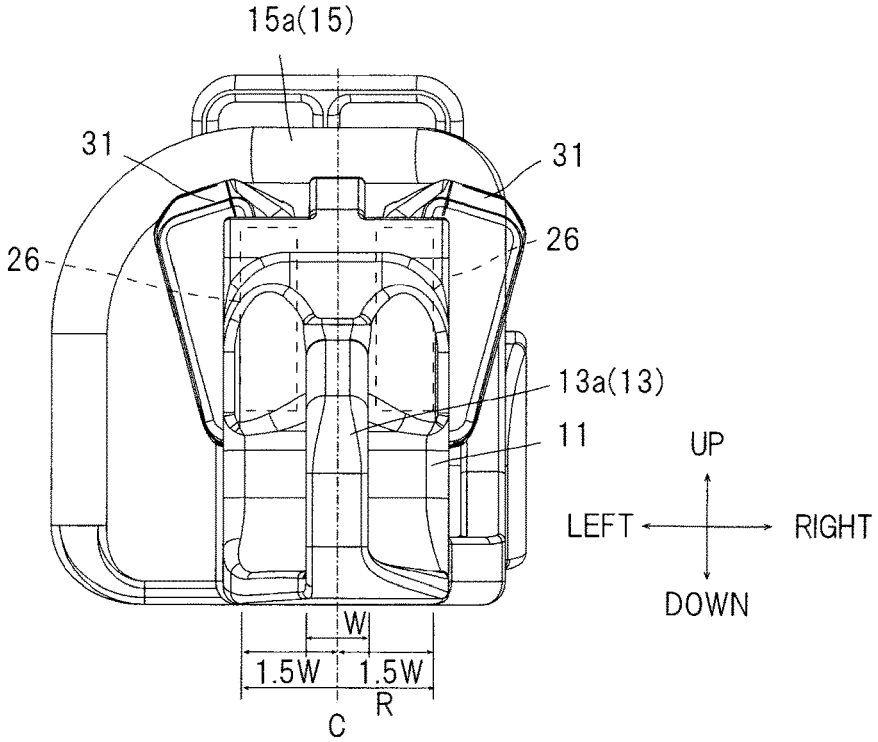
FIG. 8 is a rear view of a first alternative embodiment.

As shown in the rear view of FIG. 4, the attachment section 25 is arranged in a standing manner without tilting toward the left or right outer sides in the electric chainsaw 10 of the embodiment described above, whereas the left and right attachment sections 25 are arranged on both left and right sides of the back part of the main housing 11 such that an upper part side tilts toward the outer side, and the battery pack 31 is attached such that the upper part side tilts toward the outer side at both left and right sides of the back part of the main housing 11 in a chainsaw 10 of a first alternative embodiment, as shown in a rear view of FIG. 8.

Second Alternative Embodiment

Figure 9:
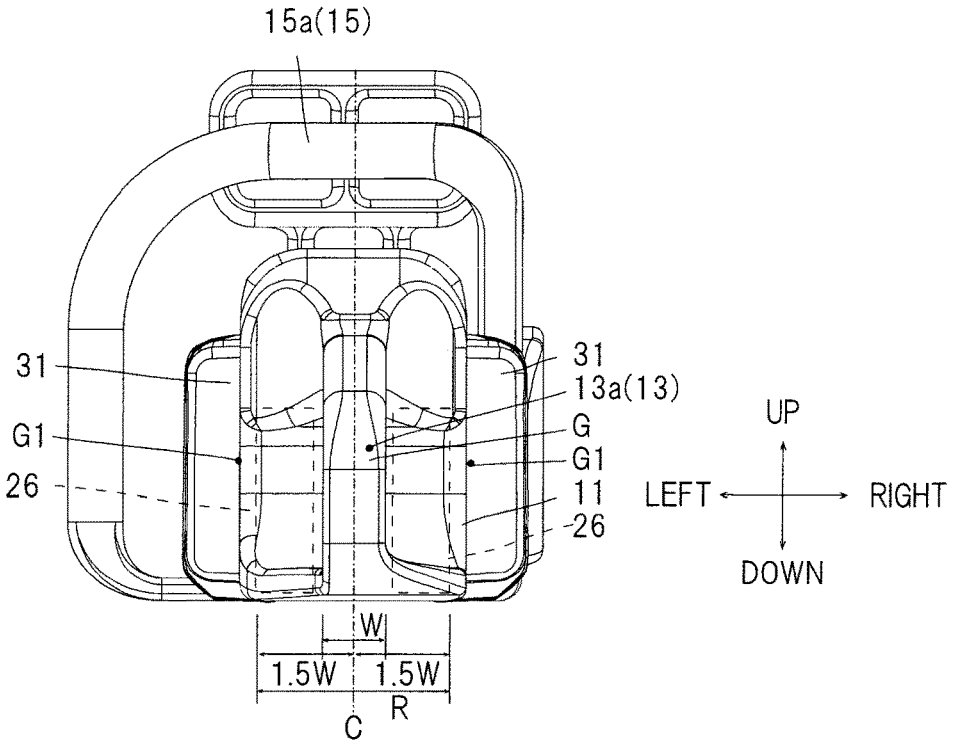
FIG. 9 is a rear view of a second alternative embodiment.

As shown in the right side view of FIG. 3 and the rear view of FIG. 4, the battery pack 31 is attached by being slidably moved from the upper side at both left and right sides of the back part of the main housing 11 in the electric chainsaw 10 of the embodiment described above, whereas the battery pack 31 is attached by being slidably moved from the lower side at both left and right sides of the back part of the main housing 11 with the attachment section 25 turned upside down in a chainsaw 10 of a second alternative embodiment, as shown in a rear view of FIG. 9.

Third Alternative Embodiment

Figure 10:
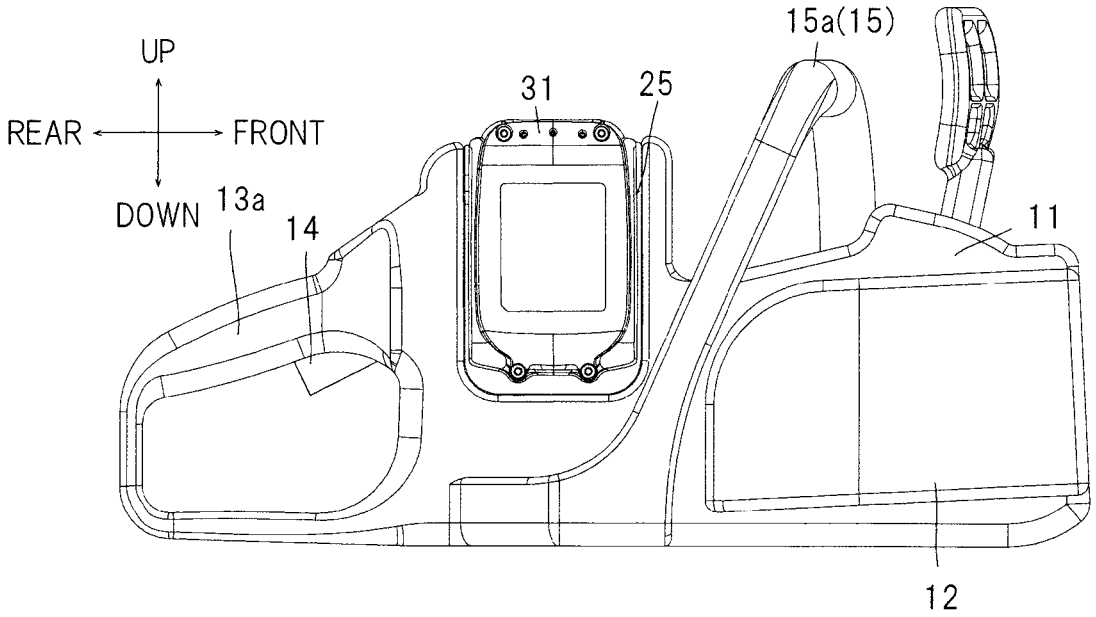
FIG. 10 is a right side view of a third alternative embodiment.

As shown in the right side view of FIG. 3, the attachment section 25 is inclined approximately 10° toward the back side from a vertical direction and the battery pack 31 is attached while being inclined approximately 10° toward the back side at both left and right sides of the back part of the main housing 11 in the electric chainsaw 10 of the embodiment described above, whereas the attachment section 25 is arranged standing in the vertical direction and the battery pack 31 is attached standing in the vertical direction at both left and right sides of the back part of the main housing 11 in a chainsaw 10 of a third alternative embodiment, as shown in a right side view of FIG. 10. In such a case, the operator can easily detach the battery pack 31 from the attachment section 25 by gripping the rear handle 13 or the front handle 15 of the chainsaw 10 placed on the ground and the like with one hand and holding it down toward the ground side, and grabbing the battery pack 31 with the other hand and pulling it out toward the upper side.

Fourth Alternative Embodiment

Figure 11:
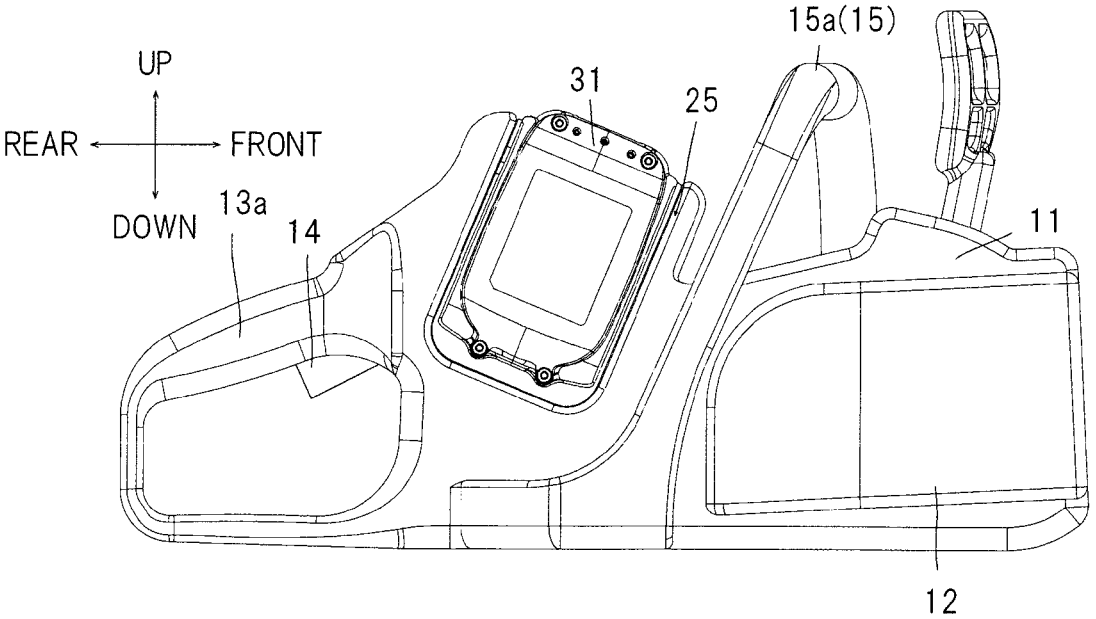
FIG. 11 is a right side view of a fourth alternative embodiment.

As shown in the right side view of FIG. 3, the attachment section 25 is inclined approximately 10° toward the back side from a vertical direction and the battery pack 31 is attached while being inclined approximately 10° toward the back side at both left and right sides of the back part of the main housing 11 in the electric chainsaw 10 of the embodiment described above, whereas the attachment section 25 is inclined approximately 10° toward the front side from the vertical direction and the battery pack 31 is attached while being inclined approximately 10° toward the front side at both left and right sides of the back part of the main housing 11 in a chainsaw 10 of a fourth alternative embodiment, as shown in a right side view of FIG. 11. In such a case, the operator can easily detach the battery pack 31 from the attachment section 25 by gripping the rear handle 13 of the chainsaw 10 placed on the ground and the like with one hand and holding it down toward the ground side, and grabbing the battery pack 31 with the other hand and pulling it out toward the diagonally upper front side, which is the side opposite to the rear handle 13.

Fifth Alternative Embodiment

Figure 12:
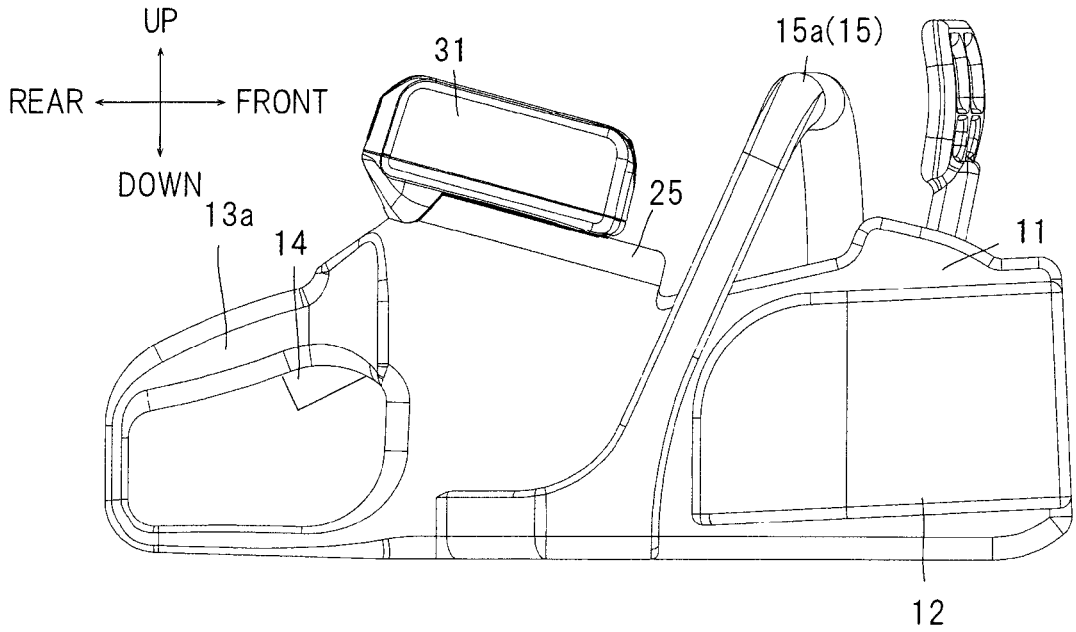
FIG. 12 is a right side view of a fifth alternative embodiment.

As shown in a right side view of FIG. 12, in an electric chainsaw 10 of a fifth alternative embodiment, two attachment sections 25 are juxtaposed on the left and right at an upper surface of the back part of the main housing 11, and a pair of battery packs 31 are attached side by side on the left and right in each of the two attachment sections 25 at the upper surface of the back part of the main housing 11. The two attachment sections 25 and the two battery packs 31 are arranged on both left and right sides of the center line C extending in an up and down direction at a center in a left and right direction of the grip section 13*a* of the rear handle 13 (rear view is omitted), and the center of gravity when seen from the back side of the chainsaw 10 is located in the range R of 1.5 times the horizontal width of the grip section 13*a* from the center line C. An interval of the wall surfaces adjacent to each other of the two battery packs 31 attached side by side on the left and right is 5 mm, so that an occupying space by the two battery packs 31 is narrowed. The occupying space by the pair of battery packs 31 can be sufficiently narrowed if the interval of the wall surfaces adjacent to each other of the pair of battery packs 31 is smaller than 15 mm.

The attachment section 25 is inclined such that the back part becomes the upper side at the upper surface of the back part of the main housing 11, and the battery pack 31 is attached while being inclined such that the back part becomes the upper side at the upper surface of the back part of the main housing 11. In such a case, the operator can easily detach the battery pack 31 from the attachment section 25 by gripping the side handle 15 of the chainsaw 10 placed on the ground and the like with one hand and holding it down toward the ground side, and grabbing the battery pack 31 with the other hand and pulling it out toward the diagonally upper back side, which is the side opposite to the front handle 15.

Sixth Alternative Embodiment

Figure 13:
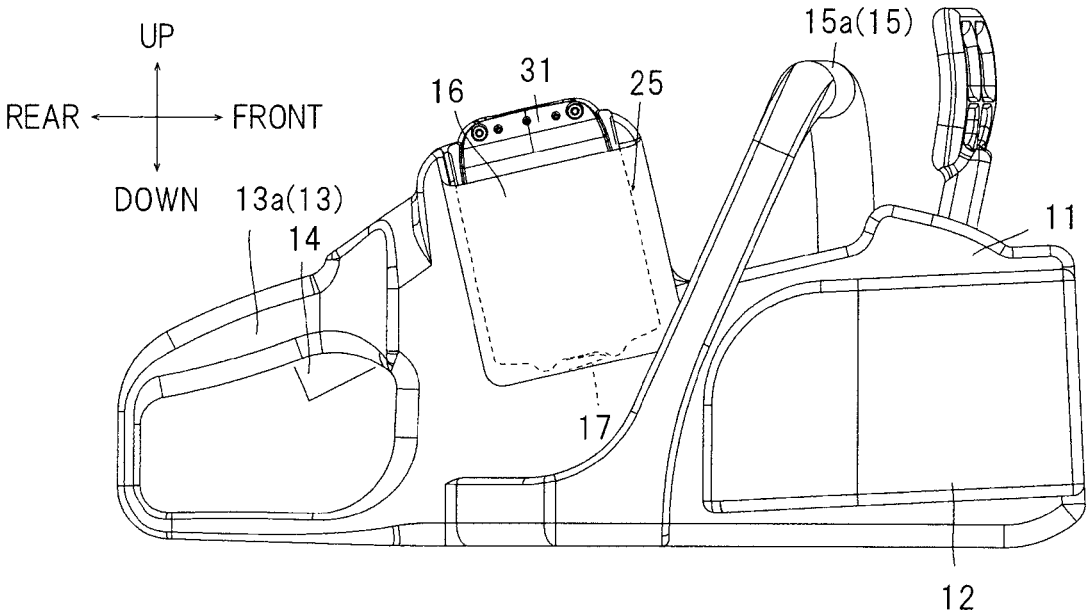
FIG. 13 is a right side view of a sixth alternative embodiment.

As shown in a right side view of FIG. 13, in an electric chainsaw 10 of a sixth alternative embodiment, a battery pack accommodation cover 16 in which an upper surface is opened is arranged at a periphery of each attachment section 25 of the main housing 11 in the chainsaw 10 of the embodiment described above. The battery pack accommodation cover 16 covers the battery pack 31 other than an upper end portion thereof. Since the battery pack accommodation cover 16 covers a majority of the battery pack 31, the battery pack 31 is less likely to be scratched during the operation. The spring member 17 including a plate spring is arranged at a bottom part of the battery pack accommodation cover 16, and the battery pack 31 is biased toward the upper side by the spring member 17. When the hook 36 of the battery pack 31 is released from the locking portion 25*c* of the attachment section 25 from a state in which the battery pack 31 is attached to the attachment section 25 in the battery pack accommodation cover 16, the battery pack 31 is pushed out toward the upper side by the biasing force of the spring member 17. The upper part of the battery pack 31 thus projects out from the opening at the upper surface of the battery pack accommodation cover 16, and hence the battery pack 31 can be easily detached by grabbing the upper part of the battery pack 31 and pulling out the battery pack toward the upper side from the battery pack accommodation cover 16.

Seventh Alternative Embodiment

Figure 14A:
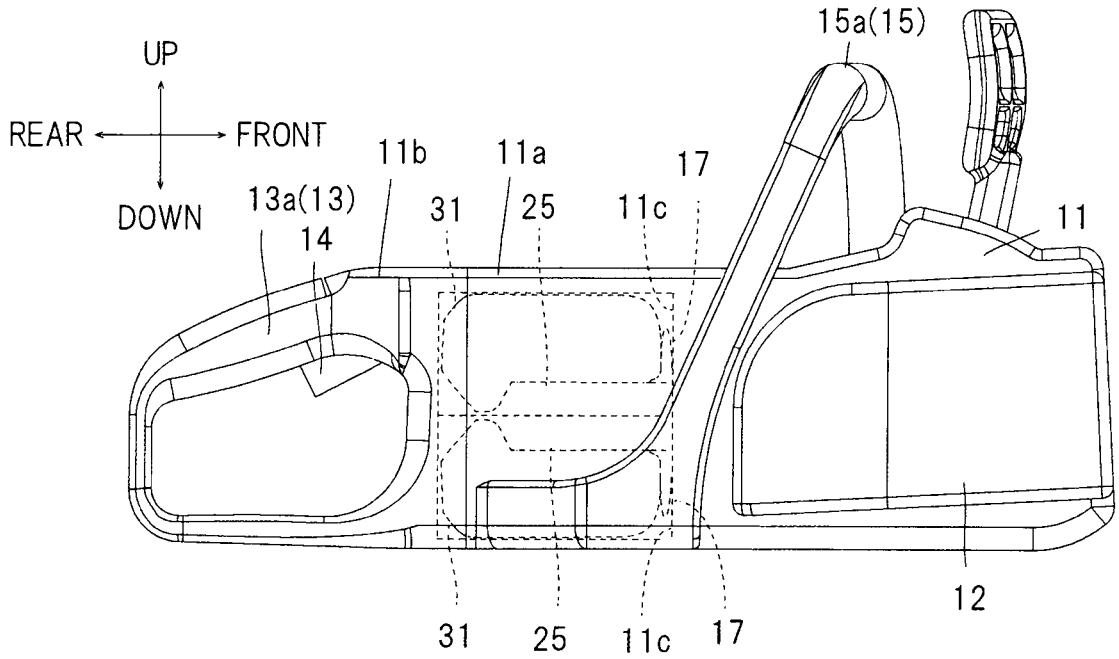
FIG. 14(*a*) is a right side view of a seventh alternative embodiment.
Figure 14B:
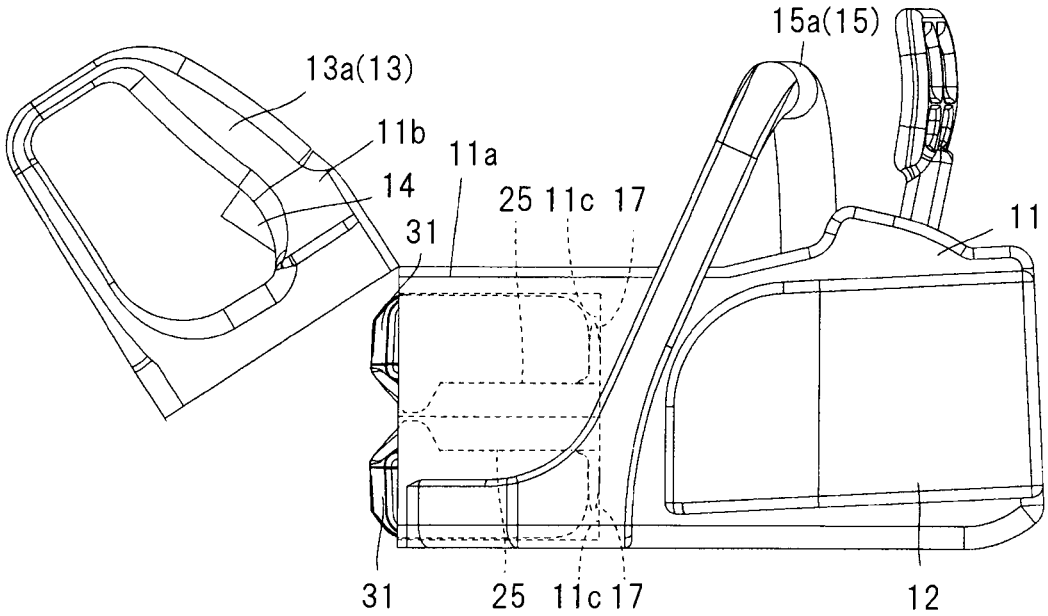

As shown in a right side view of FIG. 14, in an electric chainsaw 10 of a seventh alternative embodiment, a battery pack accommodating portion 11*c* is arranged inside the main housing 11. The main housing 11 is divided to a main part 11*a* excluding the back part and a back part 11*b* including the rear handle 13, where an upper end on the front side of the back part 11*b* is supported to be turnable about a horizontal axis line at an upper end on the back side of the main part 11*a*. Two battery pack accommodating portions 11*c* are arranged one above the other in the main part 11*a* of the main housing 11, and the battery pack accommodating portion 11*c* has the back side opened when the back part 11*b* is turned. The battery pack 31 is removably accommodated in each upper and lower battery pack accommodating portion 11*c* from the opening on the back side. The attachment section 25 described above is arranged in each battery pack accommodating portion 11*c*, and the battery pack 31 accommodated in each battery pack accommodating portion 11*c* is removably attached to the attachment section 25. The attachment section 25 of the upper stage is arranged at a lower part of the battery pack accommodating portion 11*c*, and the attachment section 25 of the lower stage is arranged at an upper part of the battery pack accommodating portion 11*c*, where the attachment sections 25 of the upper stage and the lower stage are arranged at positions adjacent to each other.

The spring member 17 including the plate spring is arranged at the back, which becomes the front part of each battery pack accommodating portion 11*c*, and the battery pack 31 is biased toward the back side by the spring member 17. When the back part 11*b* of the main housing 11 is turned toward the upper side to release the hook 36 of the battery pack 31 from the locking portion 25*c* of the attachment section 25 with the battery pack 31 attached to the attachment section 25 in the battery pack accommodating portion 11*c*, the battery pack 31 is pushed out toward the back side by the biasing force of the spring member 17. The back part of the battery pack 31 thus projects out from the opening on the back side of the battery pack accommodating portion 11*c*, and hence the battery pack 31 can be easily detached by grabbing the back part of the battery pack 31 and pulling out the battery pack toward the back side from the battery pack accommodating portion 11*c*.

Eighth Alternative Embodiment

Figure 15A:
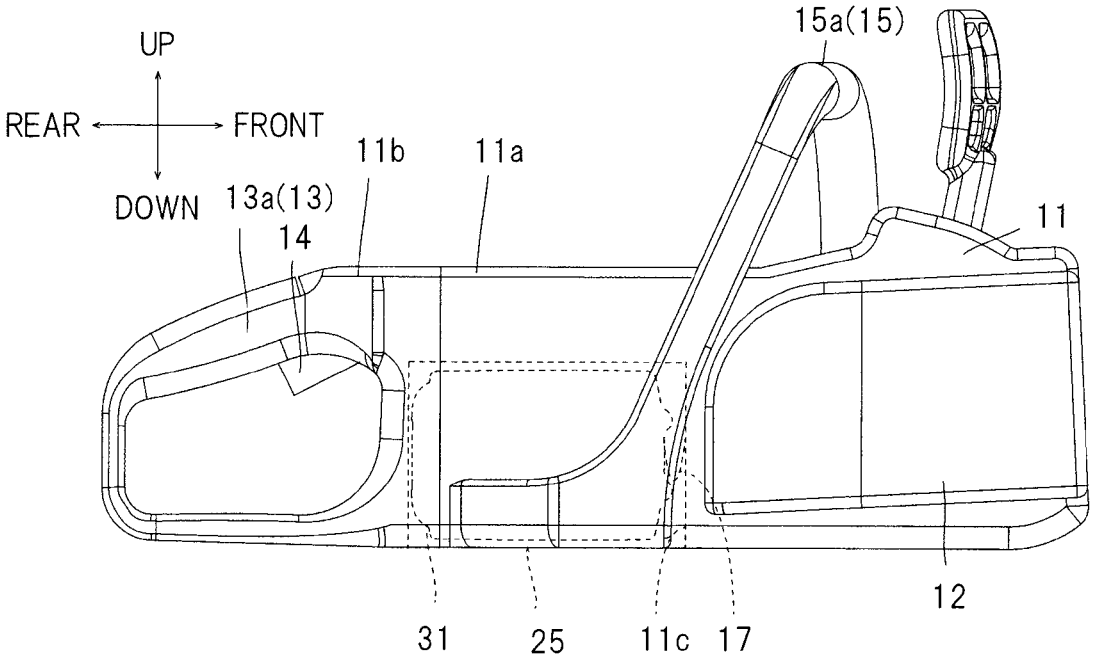
FIG. 15(*a*) is a right side view of an eighth alternative embodiment.
Figure 15B:
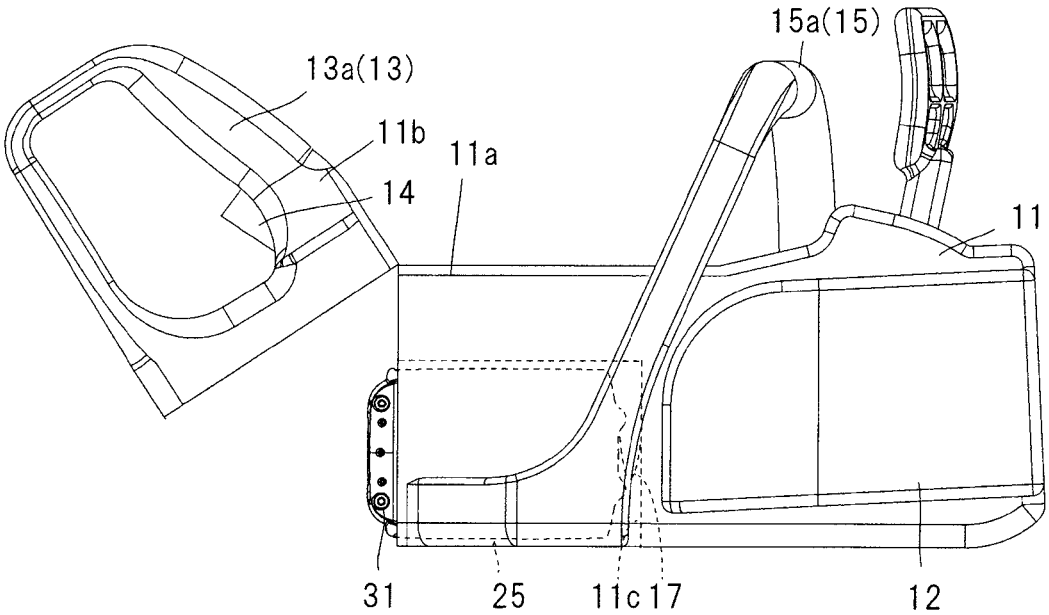

As shown in a right side view of FIG. 15, in an electric chainsaw 10 of an eighth alternative embodiment, the battery pack accommodating portion 11*c* is arranged inside the main housing 11. The main housing 11 is divided to a main part 11*a* excluding the back part, and a back part 11*b* including the rear handle 13, where the upper end on the front side of the back part 11*b* is supported to be turnable about the horizontal axis line at the upper end on the back side of the main part 11*a*. Two battery pack accommodating portions 11*c* are arranged on the left and right in the main part 11*a* of the main housing 11 (only the battery pack accommodating portion 11*c* on the right side is shown in FIG. 15, and the illustration of the battery pack accommodating portion 11*c* on the left side, which is symmetric to the right side, is omitted), and the battery pack accommodating portion 11*c* has the back side opened when the back part 11*b* is turned. The battery pack 31 is removably accommodated in each battery pack accommodating portion 11*c* on the left and right from the opening on the back side. The attachment section 25 described above is arranged in each battery pack accommodating portion 11*c*, and the battery pack 31 accommodated in each battery pack accommodating portion 11*c* is removably attached to the attachment section 25. The attachment section 25 on the left side is arranged on the right side of the battery pack accommodating portion 11*c*, and the attachment section 25 on the right side is arranged on the left side in the battery pack accommodating portion 11*c*, and the left and right attachment sections 25 are arranged at positions adjacent to each other at the central part in the left and right direction of the main housing 11.

Similar to the seventh alternative embodiment, the spring member 17 including the plate spring is arranged at the back, which becomes the front part of each battery pack accommodating portion 11*c*, and the battery pack 31 is biased toward the back side by the spring member 17. When the back part 11*b* of the main housing 11 is turned toward the upper side to release the hook 36 of the battery pack 31 from the locking portion 25*c* of the attachment section 25 with the battery pack 31 attached to the attachment section 25 in the battery pack accommodating portion 11*c*, the battery pack 31 is pushed out toward the back side by the biasing force of the spring member 17. The back part of the battery pack 31 thus projects out from the opening on the back side of the battery pack accommodating portion 11*c*, and hence the battery pack 31 can be easily detached by grabbing the back part of the battery pack 31 and pulling out the battery pack toward the back side from the battery pack accommodating portion 11*c*.

Ninth Alternative Embodiment

Figure 16:
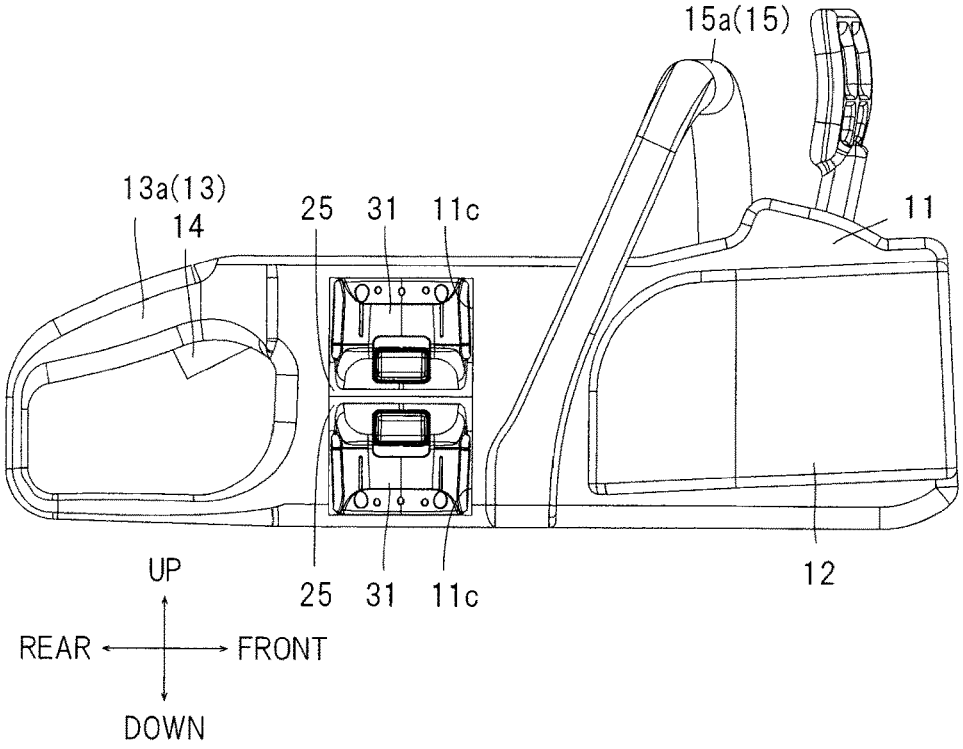
FIG. 16 is a right side view of a ninth alternative embodiment.

As shown in a right side view of FIG. 16, in an electric chainsaw 10 of a ninth alternative embodiment, the battery pack accommodating portion 11*c* is arranged in two stages, upper and lower, at the back part of the main housing 11. The battery pack accommodating portion 11*c* has the right side surface side opened, and the battery pack 31 is accommodated in the battery pack accommodating portion 11*c* from such opening. The attachment section 25, described above, is arranged in the battery pack accommodating portion 11*c*, and the battery pack 31 accommodated in each battery pack accommodating portion 11*c* is removably attached to the attachment section 25. The attachment section 25 of the upper stage is arranged at a lower part of the battery pack accommodating portion 11*c*, and the attachment section 25 of the lower stage is arranged at an upper part of the battery pack accommodating portion 11*c*, where the attachment sections 25 of the upper stage and the lower stage are arranged at positions adjacent to each other.

A spring member (not shown) including the plate spring is arranged as shown in the seventh alternative embodiment at the back, which becomes the left side part of the battery pack accommodating portion 11*c*, and the battery pack 31 is biased toward the right side by the spring member. When the hook 36 of the battery pack 31 is released from the locking portion 25*c* of the attachment section 25 with the battery pack 31 attached to the attachment section 25 in the battery pack accommodating portion 11*c*, the battery pack 31 is pushed out toward the right side by the biasing force of the spring member. The right side part of the battery pack 31 thus projects out from the opening on the right side of the battery pack accommodating portion 11*c*, and hence the battery pack 31 can be easily detached by grabbing the right side part of the battery pack 31 and pulling out the battery pack toward the right side from the battery pack accommodating portion 11*c*.

Tenth Alternative Embodiment

Figure 17:
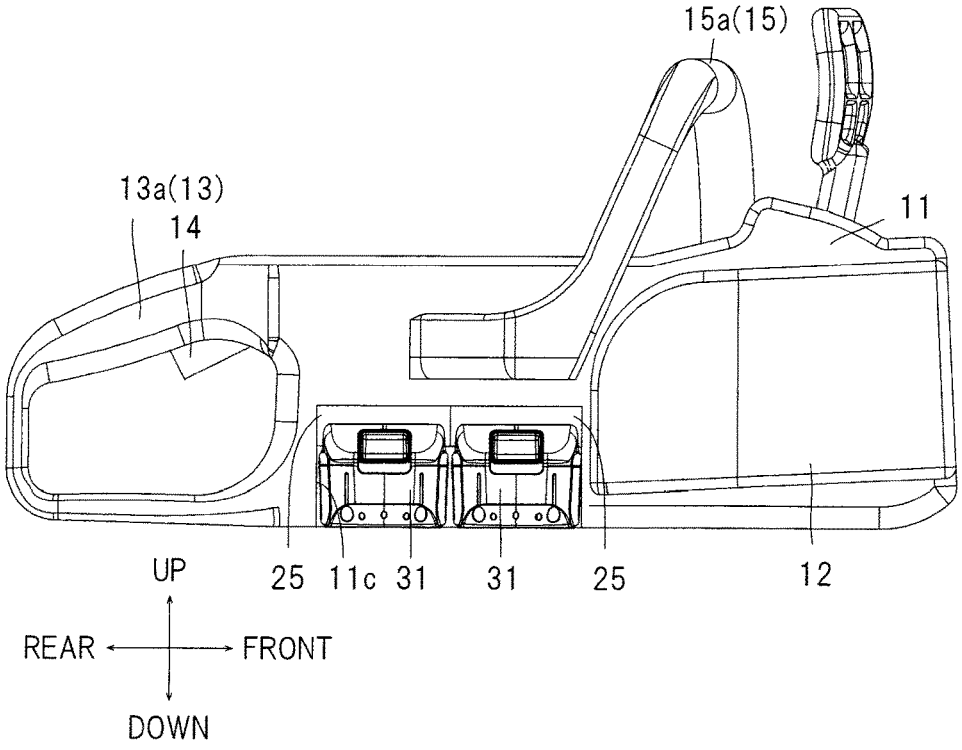
FIG. 17 is a right side view of a tenth alternative embodiment.

As shown in FIG. 17, an electric chainsaw 10 of a tenth alternative embodiment has two battery pack accommodating portions 11*c* arranged on the front and back at the back part on the lower side of the main housing 11. The battery pack accommodating portion 11*c* has the right side surface side opened, and the battery pack 31 is accommodated in the battery pack accommodating portion 11*c* from such opening. An interval of the wall surfaces adjacent to each other of the two battery packs 31 attached side by side to the front and back is 5 mm, and an occupying space by the two battery packs 31 is narrowed. The occupying space by the two battery packs 31 can be sufficiently narrowed if the interval of the wall surfaces adjacent to each other of the two battery packs 31 is smaller than 15 mm. The attachment section 25 described above is arranged at the upper part of the battery pack accommodating portion 11*c*, and the battery pack 31 accommodated in each battery pack accommodating portion 11*c* is removably attached to the attachment section 25.

A plate spring member (not shown) is arranged as shown in the seventh and eighth alternative embodiment at the back, which becomes the left side part of the battery pack accommodating portion 11*c*, and the battery pack 31 is biased toward the right side by the spring member. When the hook 36 of the battery pack 31 is released from the locking portion 25*c* of the attachment section 25 with the battery pack 31 attached to the attachment section 25 in the battery pack accommodating portion 11*c*, the battery pack 31 is pushed out toward the right side by the biasing force of the spring member. The right side part of the battery pack 31 thus projects out from the opening on the right side of the battery pack accommodating portion 11*c*, and hence the battery pack 31 can be easily detached by grabbing the right side part of the battery pack 31 and pulling out the battery pack toward the right side from the battery pack accommodating portion 11*c*.

Eleventh Alternative Embodiment

Figure 18:
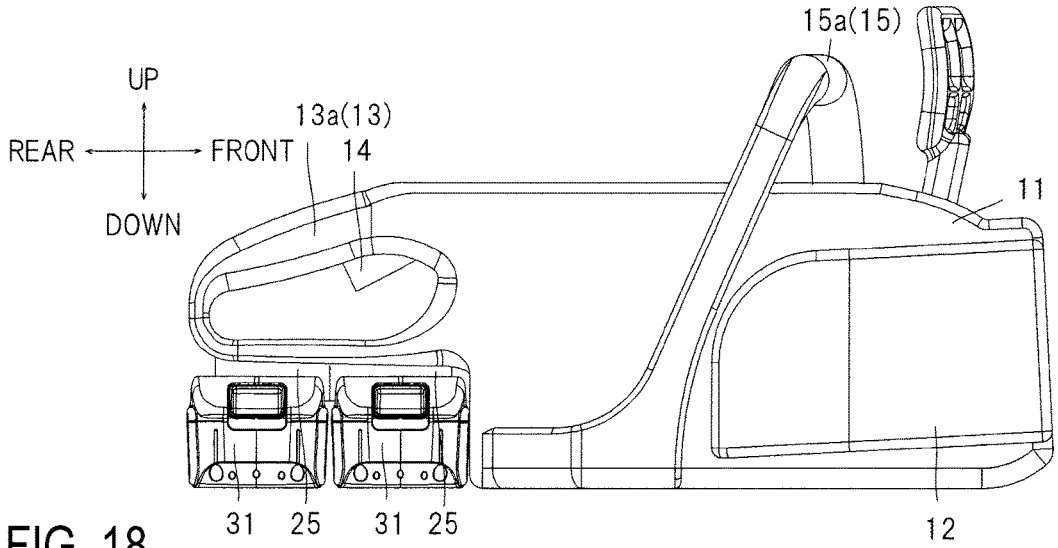
FIG. 18 is a right side view of an eleventh alternative embodiment.

As shown in FIG. 18, in an electric chainsaw 10 of an eleventh alternative embodiment, two attachment sections 25 are arranged juxtaposed to the front and back on the lower side of the rear handle 13 at the back part of the main housing 11, and two battery packs 31 are attached side by side to the front and back on the lower side of the rear handle 13 at the back part of the main housing 11. The interval of the wall surfaces adjacent to each other of the two battery packs 31 attached side by side to the front and back is 5 mm, so that the occupying space by the two battery packs 31 is narrowed. The occupying space by the two battery packs 31 can be sufficiently narrowed if the interval of the wall surfaces adjacent to each other of the two battery packs 31 is smaller than 15 mm. The respective center of gravity of the two battery packs 31 when seen from the back side is located in the range R of 1.5 times the horizontal width of the grip section 13*a* at both left and right sides of the center line C extending perpendicularly at the center in the left and right direction of the grip section 13*a* of the rear handle 13, and the center of gravity when seen from the back side of the chainsaw 10 is located within the range R of 1.5 times the horizontal width of the grip section 13*a* at both left and right sides of the center line C extending in the up and down direction of the grip section 13*a* of the rear handle 13. In the example described above, the interval of the wall surfaces adjacent to each other of the pair of battery packs 31 is 5 mm, but if the interval of the wall surfaces adjacent to each other of the two battery packs 31 is greater than or equal to 15 mm, a finger can be inserted between the two battery packs 31 to facilitate the attachment/detachment operation.

Twelfth Alternative Embodiment

Figure 19:
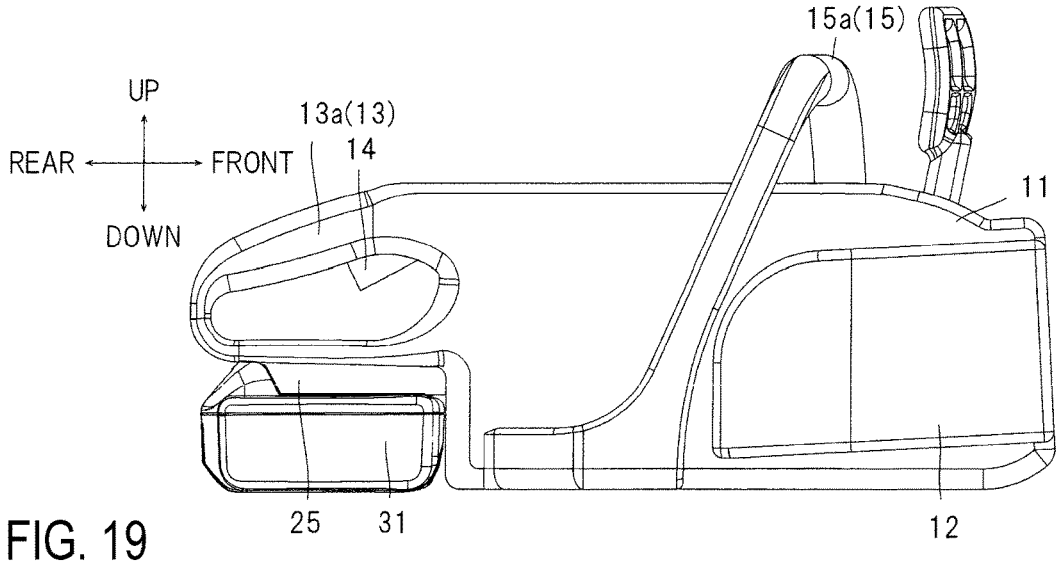
FIG. 19 is a right side view of a twelfth alternative embodiment.

As shown in FIG. 19, in an electric chainsaw 10 of a twelfth alternative embodiment, two attachment sections 25 are arranged juxtaposed to the left and right on the lower side of the rear handle 13 at the back part of the main housing 11, and two battery packs 31 are attached side by side to the left and right on the lower side of the rear handle 13 at the back part of the main housing 11 (in FIG. 19, the attachment section 25 on the right side and the battery pack 31 on the right side are shown, and the illustration of the attachment section 25 on the left side and the battery pack 31 on the left side, which are symmetric to the right side, is omitted). The interval of the wall surfaces adjacent to each other of the two battery packs 31 attached side by side to the left and right is 5 mm, so that the occupying space by the two battery packs 31 is narrowed. The occupying space by the two battery packs 31 can be sufficiently narrowed if the interval of the wall surfaces adjacent to each other of the two battery packs 31 is smaller than 15 mm. The respective center of gravity of the two battery packs 31 when seen from the back side is located in the range R of 1.5 times the horizontal width of the grip section 13*a* at both left and right sides of the center line C extending in the up and down direction of the grip section 13*a* of the rear handle 13, and the center of gravity when seen from the back side of the chainsaw 10 is located within the range R of 1.5 times the horizontal length of the grip section 13*a* at both left and right sides of the center line C in the left and right direction extending in the up and down direction of the grip section 13*a* of the rear handle 13. Furthermore, the two battery packs 31 are arranged such that each center of gravity G1 is divided to both left and right sides of the center line C extending in the up and down direction of the grip section 13*a*. In the example described above, the interval of the wall surfaces adjacent to each other of the two battery packs 31 is 5 mm, but if the interval of the wall surfaces adjacent to each other of the two battery packs 31 is greater than or equal to 15 mm, a finger can be inserted between the two battery packs 31 to facilitate the attachment/detachment operation.

Thirteenth Alternative Embodiment

Figure 20:
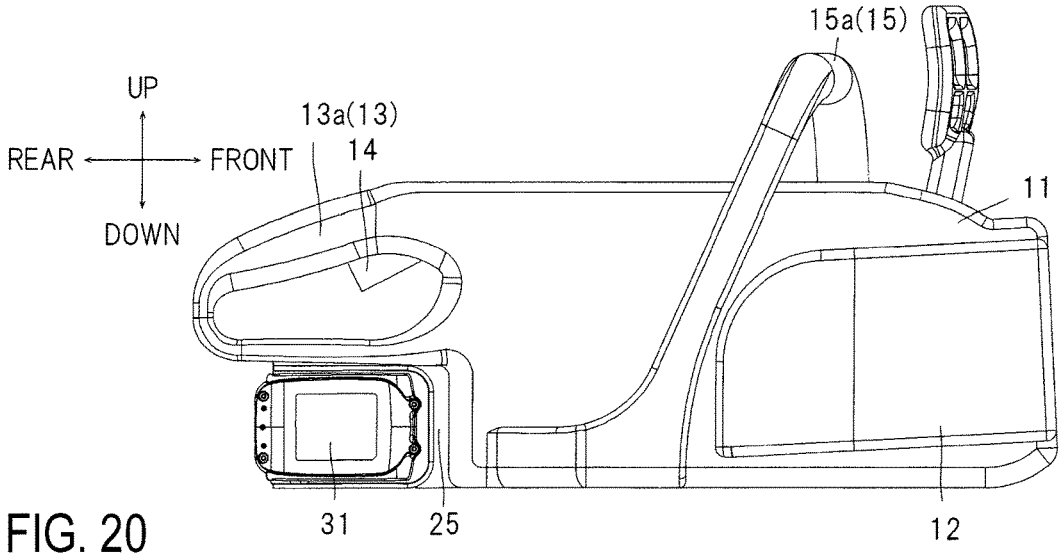
FIG. 20 is a right side view of a thirteenth alternative embodiment.

As shown in FIG. 20, in an electric chainsaw 10 of a thirteenth alternative embodiment, two attachment sections 25 are arranged at a central part in the left and right direction on the lower side of the rear handle 13 at the back part of the main housing 11, and two battery packs 31 are attached to both left and right sides on the lower side of the rear handle 13 at the back part of the main housing 11 (in FIG. 20, the attachment section 25 on the right side and the battery pack 31 on the right side are shown, and the illustration of the attachment section 25 on the left side and the battery pack 31 on the left side, which are symmetric to the right side, is omitted). The respective center of gravity G of the two battery packs 31 when seen from the back side is located in the range R of 1.5 times the width of the grip section 13*a* at both left and right sides of the center line C extending in the up and down direction of the grip section 13*a* of the rear handle 13, and the center of gravity when seen from the back side of the chainsaw 10 is located within the range R of 1.5 times the width of the grip section 13*a* at both left and right sides of the center line C extending in the up and down direction of the grip section 13*a* of the rear handle 13. Furthermore, the two battery packs 31 are arranged such that each center of gravity G1 is divided to both left and right sides of the center line C extending in the up and down direction of the grip section 13*a*.

In the chainsaws 10 configured as above, description has been made that the two battery packs 31 are series-connected with respect to the electric motor 23, but the present invention is not limited thereto. The electric motor 23 can be used with high output when the pair of battery packs 31 are series-connected with respect to the electric motor 23, whereas the electric motor 23 can be used for a long period of time when the pair of battery packs 31 are parallel-connected with respect to the electric motor 23. The series connection and the parallel connection can be selected by a control circuit.

REFERENCE SIGNS LIST

10 chainsaw
11 main housing
21 guide bar
22 saw chain
23 electric motor
25 attachment section
25*a* connector portion
25*b* guide rail
25*c* locking portion
30 power source
31 battery pack
32 housing
33 battery cell
34 electric connector
35 rail
36 hook
G center of gravity of chainsaw
G1 center of gravity of battery pack
C center line (center line in left and right direction extending in up and down direction when grip section is seen from back side)
R range (range of 1.5 times horizontal length of grip section at both left and right sides from center line C of grip section)

What is claimed is:

1. A chainsaw comprising:

a main body casing;

a guide bar projecting forward from the main body casing;

a saw chain stretched over an outer periphery of the guide bar;

an electric motor that is in the main body casing and rotates the saw chain along the outer periphery of the guide bar;

a rear handle extending rearward from a rear of the main body casing and having a grip section configured to be gripped by an operator; and a plurality of rechargeable battery packs that are removably attached to the main body casing, the battery packs being a power source by which power is supplied to the electric motor; wherein:

the battery packs are attached to the rear of the main body casing below the rear handle;

the main body casing, the guide bar, the electric motor, the rear handle and the plurality of battery packs are configured such that a center of gravity of the chainsaw when viewed from a rear side is located within a range of 1.5 times a horizontal width of the grip section on both right and left sides of a center line vertically extending at a center in a left and right direction of the grip section, the center of gravity being offset from the center line; and a center of gravity of each of the plurality of battery packs is arranged so as to be located within the range of 1.5 times the horizontal width of the grip section on both right and left sides of the center line vertically extending at the center in the left and right direction of the grip section.

2. The chainsaw according to claim 1, wherein:

when there are two sets of the plurality of battery packs, a center of gravity of each of the two battery packs is arranged so as to be divided to both right and left sides of the center line vertically extending at the center in the left and right direction of the grip section.

3. The chainsaw according to claim 1, wherein:

the plurality of battery packs are arranged in parallel.

4. The chainsaw according to claim 3, wherein:

a distance between adjacent wall surfaces of the plurality of battery packs arranged in parallel is less than 15 mm.

5. The chainsaw according to claim 1, further comprising:

a plurality of attachment portions for attaching the plurality of battery packs to the main body casing.

6. The chainsaw according to claim 5, wherein:

each of the battery packs is provided with (i) an electrical connector on a peripheral wall of a casing in which a battery is housed and (ii) a pair of rails arranged at respective sides of the electrical connector, and each of the plurality of attachment portions is provided with (i) a connector electrically connected to the electrical connector and (ii) a pair of guide rails that slidably engage the pair of rails, the guide rails being arranged at respective sides of the connector.

7. The chainsaw according to claim 1, wherein:

the plurality of battery packs are connected in series to the electric motor.

8. The chainsaw according to claim 1, wherein:

the plurality of battery packs are connected in parallel to the electric motor.

* * * * *